US008330677B2

(12) United States Patent
Kim

(10) Patent No.: US 8,330,677 B2
(45) Date of Patent: Dec. 11, 2012

(54) ORGANIC ELECTRO-LUMINESCENT DISPLAY DEVICE AND METHOD FOR DRIVING THE SAME

(75) Inventor: Kyung Man Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 2299 days.

(21) Appl. No.: 11/171,699

(22) Filed: Jun. 30, 2005

(65) Prior Publication Data

US 2006/0066252 A1 Mar. 30, 2006

(30) Foreign Application Priority Data

Sep. 30, 2004 (KR) ..... 10-2004-0077890

(51) Int. Cl.
*G09G 3/30* (2006.01)

(52) U.S. Cl. ..... 345/76

(58) Field of Classification Search ..... 345/76–83; 315/169.3

See application file for complete search history.

(56) References Cited

U.S. PATENT DOCUMENTS 6,204,574 B1 * 3/2001 Chi ..... 307/66
6,617,796 B2 * 9/2003 Sasaki et al. ..... 315/169.1
6,750,833 B2 * 6/2004 Kasai ..... 345/76
7,202,842 B2 * 4/2007 Kasai et al. ..... 345/78
7,317,433 B2 * 1/2008 Chen et al. ..... 345/76
2002/0080133 A1 * 6/2002 Eu ..... 345/212
2002/0140659 A1 * 10/2002 Mikami et al. ..... 345/90
2003/0107565 A1 * 6/2003 Libsch et al. ..... 345/211
2006/0038758 A1 * 2/2006 Routley et al. ..... 345/81

* cited by examiner

*Primary Examiner* — Alexander Eisen
(74) *Attorney, Agent, or Firm* — Brinks Hofer Gilson & Lione

(57) ABSTRACT

An organic electro-luminescent display device has a gate-source voltage that selectively has a positive polarity and a negative polarity so that deterioration of the switching element is prevented. The display device includes an electro-luminescent element that emits light. The device includes a first switching element for switching a data voltage in response to a scan signal, a second switching element for adjusting the amount of the current supplied to the electro-luminescent element, and a polarity controller for applying a voltage having a value between a minimum value and a maximum value of the data voltage to a source terminal of the second switching element to vary a polarity of a gate-source voltage of the second switching element according to the data voltage applied to a gate terminal of the second switching element.

16 Claims, 8 Drawing Sheets

ORGANIC ELECTRO-LUMINESCENT DISPLAY DEVICE AND METHOD FOR DRIVING THE SAME

This application claims the benefit of Korean Patent Application No. P2004-77890, filed on Sep. 30, 2004, which is hereby incorporated by reference as if fully set forth herein.

BACKGROUND OF THE INVENTION

1. Field of the Invention

The present invention relates to an organic electro-luminescent display device, and more particularly, to an organic electro-luminescent display device and a method for driving the organic electro-luminescent display device.

2. Discussion of the Related Art

Various flat panel display devices have been developed to reduce weight and volume which are disadvantages of a cathode ray tube. These flat panel display devices may be, for example, a liquid crystal display, a field emission display, a plasma display panel, an electro-luminescent display, and the like.

Research has been actively done for increasing the display quality and screen of such flat panel display devices. The electro-luminescent display, among them, is a spontaneous emission device that emits light by itself. This electro-luminescent display displays a video image by electrically exciting fluorescent material using carriers such as electrons and holes. Such electro-luminescent displays are roughly classified into an inorganic electro-luminescent display device and an organic electro-luminescent display device according to the type of materials used therein. The organic electro-luminescent display device is driven at a low voltage of about 5 to 20V. The organic electro-luminescent display device can be driven at a direct current (DC) low voltage as compared with the inorganic electro-luminescent display device which requires a high drive voltage of 100 to 200V. The organic electro-luminescent display device also has superior characteristics of a wide viewing angle, a high-speed response, a high contrast ratio, etc., so that it can be utilized as a pixel of a graphic display, or a pixel of a television image display or surface light source. In addition, because the organic electro-luminescent display device is thin, light and colorful, it is suitable as a next-generation flat panel display.

On the other hand, a passive matrix type driving system having no separate thin film transistor is mainly used as a driving system of the organic electro-luminescent display device.

However, the passive matrix type driving system has many limiting factors in resolution, power consumption, lifetime, etc. For this reason, efforts have recently been made to research and develop an active matrix type electro-luminescent display device for fabrication of a next-generation display requiring a high resolution or large screen.

FIG. 1 is a circuit diagram showing a basic pixel structure of a conventional active matrix type organic electro-luminescent display device.

The basic pixel structure of the conventional active matrix type organic electro-luminescent display device includes, as shown in FIG. 1, a gate line GL arranged in one direction, a data line DL arranged perpendicularly to the gate line GL, an electro-luminescent element D formed in a pixel defined by the gate line GL and the data line DL, a voltage supply line 110 for supplying a DC voltage to the anode of the electro-luminescent element D, a first NMOS transistor NT1 having a gate terminal connected to the gate line GL and a drain terminal connected to the data line DL, a second NMOS transistor NT2 having a gate terminal connected to the source terminal of the first NMOS transistor NT1, a drain terminal connected to the cathode of the electro-luminescent element D and a source terminal connected to a ground terminal, and a capacitor Cst connected between the gate terminal and source terminal of the second NMOS transistor NT2.

The first NMOS transistor NT1 is turned on in response to a scan signal from the gate line GL to form a current path between the source terminal and drain terminal thereof. The first NMOS transistor NT1 is also turned off when the voltage on the gate line GL is lower than a threshold voltage Vth thereof. During a turn-on time of the first NMOS transistor NT1, a data voltage from the data line DL is applied to the gate terminal of the second NMOS transistor NT2 through the drain terminal of the first NMOS transistor NT1. When the first NMOS transistor NT1 is turned off, the current path between the source terminal and drain terminal of the first NMOS transistor NT1 is opened, thereby causing the data voltage not to be applied to the gate terminal of the second NMOS transistor NT2.

The second NMOS transistor NT2 adjusts the amount of current flowing between the source terminal and drain terminal thereof according to the level of the data voltage applied to the gate terminal thereof to actuate the electro-luminescent element D so as to emit light of an intensity corresponding to the data voltage.

The capacitor Cst maintains the data voltage applied to the gate terminal of the second NMOS transistor NT2 constantly for a period of one frame. The capacitor Cst also maintains current applied to the electro-luminescent element D constantly for the period of one frame.

Meanwhile, the data voltage applied to the gate terminal of the second NMOS transistor NT2 always has a constant polarity (positive polarity), and the source terminal of the second NMOS transistor NT2 is connected to the ground terminal. As a result, the gate-source voltage of the second NMOS transistor NT2 always has the positive polarity, resulting in a problem in that the threshold voltage of the second NMOS transistor NT2 rises continuously toward one polarity (positive polarity). The rising of the threshold voltage of the second NMOS transistor NT2 causes a reduction in the amount of current supplied to the electro-luminescent element D and, in turn, a reduction in brightness of the electro-luminescent element D, which leads to a degradation in image quality. Therefore, a need exists for providing a driver for the electro-luminescent element that eliminates the degradation in image quality due to the continuous rise in the threshold voltage.

SUMMARY OF THE INVENTION

An organic electro-luminescent display device may include an electro-luminescent element formed in each pixel for emitting light according to current supplied thereto; a first switching element for switching a data voltage from a data line in response to a scan signal from a gate line; a second switching element for adjusting the amount of the current supplied to the electro-luminescent element according to the data voltage switched by the first switching element; and a polarity controller for applying a voltage having a value between a minimum value and maximum value of the data voltage to a source terminal of the second switching element to vary a polarity of a gate-source voltage of the second switching element according to the data voltage applied to a gate terminal of the second switching element.

The organic electro-luminescent display device may include an electro-luminescent element formed in each pixel for emitting light according to current supplied thereto; a first switching element for switching a data voltage from a data line in response to a scan signal from a gate line; a second switching element for adjusting the amount of the current supplied to the electro-luminescent element according to the data voltage switched by the first switching element; and a polarity controller for applying a pulse voltage to a source terminal of the second switching element to vary a polarity of a gate-source voltage of the second switching element, the pulse voltage periodically having a first voltage with a value between a minimum value and maximum value of the data voltage and a second voltage higher than the maximum value of the data voltage.

An organic electro-luminescent display device also may include an electro-luminescent element formed in each pixel for emitting light according to current supplied thereto; a first switching element for switching a data voltage from a data line in response to a scan signal from a gate line; a second switching element for adjusting the amount of the current supplied to the electro-luminescent element according to the data voltage switched by the first switching element; and a polarity controller for selectively applying a voltage to a source terminal of the second switching element according to the data voltage applied to a gate terminal of the second switching element to vary a polarity of a gate-source voltage of the second switching element.

In another example, an organic electro-luminescent display device may include an electro-luminescent element formed in each pixel for emitting light according to current supplied thereto; a data modulator for receiving image data from a timing controller, inserting dummy data between the received image data and outputting the resulting image data; a data driver for generating a data voltage based on the image data and a dummy data voltage based on the dummy data and supplying the generated data voltage and dummy data voltage to a plurality of data lines, the dummy data voltage having an opposite polarity to that of the data voltage; a gate driver for sequentially outputting a first scan pulse synchronized with the data voltage and a second scan pulse synchronized with the dummy data voltage to each gate line on a frame-by-frame basis; a first switching element for switching the data voltage and the dummy data voltage in response to the first scan pulse and the second scan pulse, respectively; and a second switching element formed in each pixel for adjusting the amount of the current supplied to the electro-luminescent element according to the data voltage and dummy data voltage switched by the first switching element.

An organic electro-luminescent display device may include an electro-luminescent element formed in each pixel for emitting light according to current supplied thereto; a data modulator for receiving image data from a timing controller, inserting dummy data between the received image data and outputting the resulting image data; a data driver for generating a data voltage based on the image data and a dummy data voltage based on the dummy data and supplying the generated data voltage and dummy data voltage to a plurality of data lines, the dummy data voltage having a value lower than a minimum value of the data voltage; a gate driver for sequentially outputting a first scan pulse synchronized with the data voltage and a second scan pulse synchronized with the dummy data voltage to each gate line on a frame-by-frame basis; a first switching element for switching the data voltage and the dummy data voltage in response to the first scan pulse and the second scan pulse, respectively; a second switching element formed in each pixel for adjusting the amount of the current supplied to the electro-luminescent element according to the data voltage and dummy data voltage switched by the first switching element; and a polarity controller for applying a voltage having a value between the minimum value and a maximum value of the data voltage to a source terminal of the second switching element to vary a polarity of a gate-source voltage of the second switching element according to the data voltage.

A method for driving an organic electro-luminescent display device, where the display device includes an electro-luminescent element formed in each pixel for emitting light according to current supplied thereto, a first switching element for switching a data voltage from a data line in response to a scan signal from a gate line, and a second switching element for adjusting the amount of the current supplied to the electro-luminescent element according to the data voltage switched by the first switching element, may include the act of applying a voltage having a value between a minimum value and maximum value of the data voltage to a source terminal of the second switching element to vary a polarity of a gate-source voltage of the second switching element according to the data voltage applied to a gate terminal of the second switching element.

Another method for driving an organic electro-luminescent display device, the display device including an electro-luminescent element formed in each pixel for emitting light according to current supplied thereto, a first switching element for switching a data voltage from a data line in response to a scan signal from a gate line, and a second switching element for adjusting the amount of the current supplied to the electro-luminescent element according to the data voltage switched by the first switching element, may include the act of applying a pulse voltage to a source terminal of the second switching element to vary a polarity of a gate-source voltage of the second switching element according to the data voltage applied to a gate terminal of the second switching element, the pulse voltage periodically having a first voltage with a value between a minimum value and maximum value of the data voltage and a second voltage higher than the maximum value of the data voltage.

A method for driving an organic electro-luminescent display device, the display device including an electro-luminescent element formed in each pixel for emitting light according to current supplied thereto, a first switching element for switching a data voltage from a data line in response to a scan signal from a gate line, and a second switching element for adjusting the amount of the current supplied to the electro-luminescent element according to the data voltage switched by the first switching element, may include the act of selectively applying a voltage to a source terminal of the second switching element according to the data voltage applied to a gate terminal of the second switching element to vary a polarity of a gate-source voltage of the second switching element.

Another method for driving an organic electro-luminescent display device, the display device including an electro-luminescent element formed in each pixel for emitting light according to current supplied thereto, a first switching element for switching a data voltage from a data line in response to a scan signal from a gate line, and a second switching element for adjusting the amount of the current supplied to the electro-luminescent element according to the data voltage switched by the first switching element, may include the acts of sensing an on/off state of the organic electro-luminescent display device, and applying a voltage to a source terminal of the second switching element, at the moment that both the first switching element and second switching element are turned off as the organic electro-luminescent display device is powered off, to vary a polarity of a gate-source voltage of the second switching element.

A method for driving an organic electro-luminescent display device, the display device including an electro-luminescent element formed in each pixel for emitting light according to current supplied thereto, a first switching element for switching a data voltage from a data line in response to a scan signal from a gate line, and a second switching element for adjusting the amount of the current supplied to the electro-luminescent element according to the data voltage switched by the first switching element, may further include the acts of receiving image data from a timing controller and inserting dummy data between the received image data; outputting a data voltage based on the image data and a dummy data voltage based on the dummy data, the dummy data voltage having an opposite polarity to that of the data voltage; applying a first scan pulse synchronized with the data voltage to a gate terminal of the first switching element to turn on the first switching element so as to apply the data voltage to a gate terminal of the second switching element; and applying a second scan pulse synchronized with the dummy data voltage to the gate terminal of the first switching element to turn on the first switching element so as to apply the dummy data voltage to the gate terminal of the second switching element.

Another method for driving an organic electro-luminescent display device, the display device including an electro-luminescent element formed in each pixel for emitting light according to current supplied thereto, a first switching element for switching a data voltage from a data line in response to a scan signal from a gate line, and a second switching element for adjusting the amount of the current supplied to the electro-luminescent element according to the data voltage switched by the first switching element, also may include the acts of receiving image data from a timing controller and inserting dummy data between the received image data; outputting a data voltage based on the image data and a dummy data voltage based on the dummy data, the dummy data voltage having a value lower than a minimum value of the data voltage; applying a first scan pulse synchronized with the data voltage to a gate terminal of the first switching element to turn on the first switching element so as to apply the data voltage to a gate terminal of the second switching element; applying a second scan pulse synchronized with the dummy data voltage to the gate terminal of the first switching element to turn on the first switching element so as to apply the dummy data voltage to the gate terminal of the second switching element; and applying a voltage having a value between the minimum value and a maximum value of the data voltage to a source terminal of the second switching element to vary a polarity of a gate-source voltage of the second switching element.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the examples which are illustrated in the accompanying drawings. Wherever possible, the same reference numbers will be used throughout the drawings to refer to the same or like parts.

Figure 1:
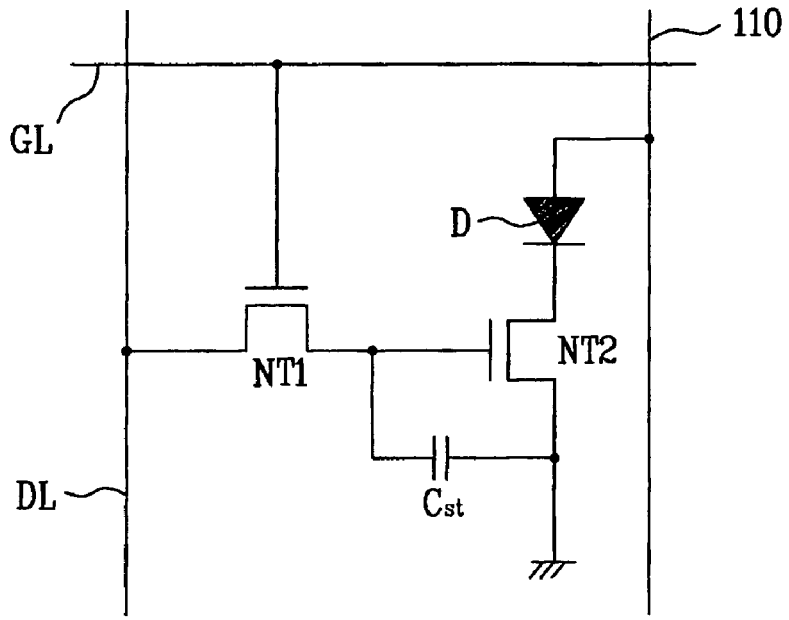
FIG. 1 Related Art
FIG. 1 is a circuit diagram of a basic pixel structure for a conventional active matrix type organic electro-luminescent display device.
Figure 2:
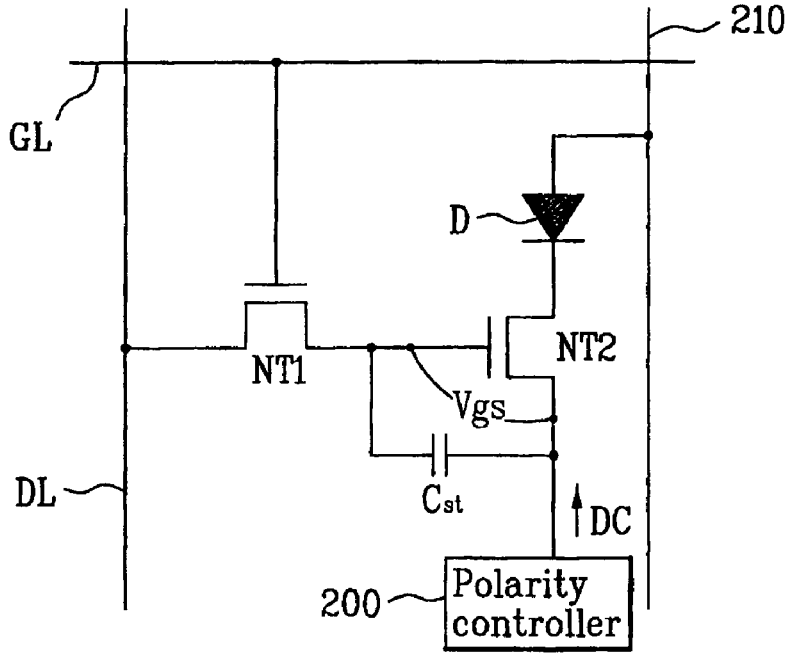
FIG. 2 is a circuit diagram of a basic pixel structure for an organic electro-luminescent display device.

FIG. 2 is a circuit diagram showing a basic pixel structure of the organic electro-luminescent display device.

The basic pixel structure of the organic electro-luminescent display device may include a gate line GL arranged in one direction and serving to transfer a scan signal from a gate driver (not shown), a data line DL arranged perpendicularly to the gate line GL and serving to transfer a data voltage from a data driver (not shown), an electro-luminescent element D formed in a pixel defined by the gate line GL and the data line DL, a voltage supply line 210 for supplying a DC voltage to the anode of the electro-luminescent element D, a first NMOS transistor NT1 turned on in response to the scan signal from the gate line GL for switching and outputting the data voltage from the data line DL, and a second NMOS transistor NT2 turned on in response to the data voltage outputted from the first NMOS transistor NT1 for adjusting the amount of current flowing between the source terminal and drain terminal thereof according to the level of the data voltage and supplying the resulting current to the cathode of the electro-luminescent element D. The basic pixel structure of the organic electro-luminescent display device also may include a capacitor Cst having one end connected to the gate terminal of the second NMOS transistor NT2 and the other end connected to the source terminal of the second NMOS transistor NT2 and serving to maintain the data voltage applied to the gate terminal of the second NMOS transistor NT2 for a period of one frame, and a polarity controller 200 for applying a voltage (referred to hereinafter as a 'critical voltage DC') having a value between the minimum value and maximum value of the data voltage to the source terminal of the second NMOS transistor NT2 to vary the polarity of a gate-source voltage Vgs of the second NMOS transistor NT2 according to the level of the data voltage applied to the gate terminal of the second NMOS transistor NT2.

A detailed description will hereinafter be given of the operation of the organic electro-luminescent display device with the above-stated configuration. The first NMOS transistor NT1 is turned on in response to the scan signal from the gate line GL to switch and output the data voltage from the data line DL. The switched data voltage is applied to the gate terminal of the second NMOS transistor NT2. When the data voltage applied to the gate terminal of the second NMOS transistor NT2 is higher than the critical voltage DC applied to the source terminal of the second NMOS transistor NT2, the gate-source voltage Vgs of the second NMOS transistor NT2 becomes positive in polarity, so that the second NMOS transistor NT2 is turned on. Conversely, when the data voltage applied to the gate terminal of the second NMOS transistor NT2 is lower than the critical voltage DC applied to the source terminal of the second NMOS transistor NT2, the gate-source voltage Vgs of the second NMOS transistor NT2 becomes negative in polarity, thereby causing the second NMOS transistor NT2 to be turned off. In this manner, the gate-source voltage Vgs of the second NMOS transistor NT2 selectively has the positive polarity and the negative polarity depending on the level of the data voltage so that the threshold voltage of the switching element is prevented from rising continuously in one direction and avoiding a degradation of the picture quality of the display.

Therefore, it is possible to prevent the threshold voltage of the second NMOS transistor NT2 from rising toward any one polarity.

Meanwhile, the level of the critical voltage DC has a great effect on a predetermined number of gray scales and the frequency of the negative polarity depends on the data voltage. For this reason, it is important to optimize the level of the critical voltage DC, as will hereinafter be described in more detail.

Figure 3:
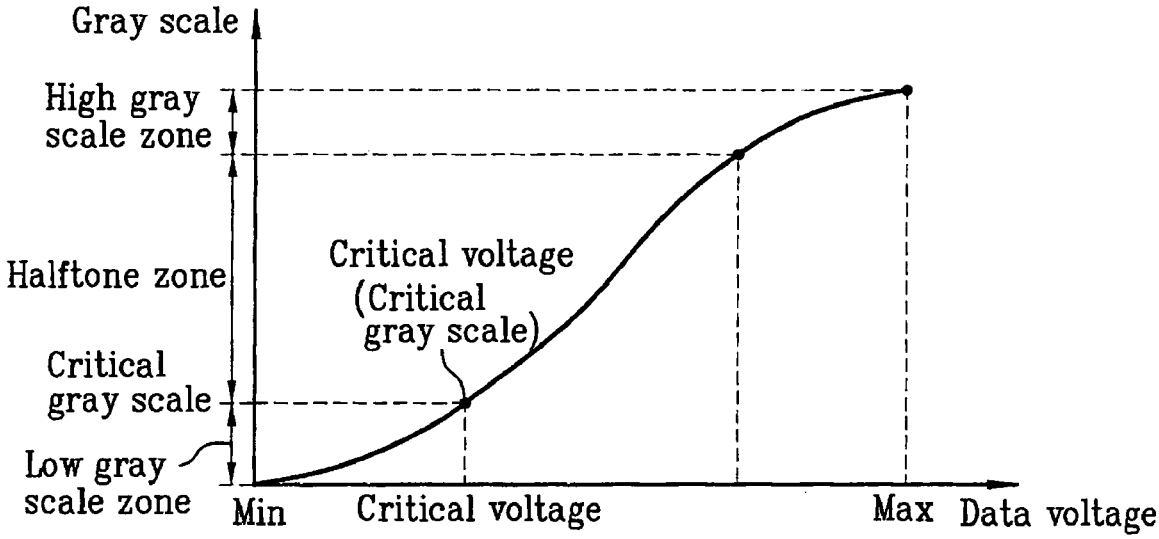
FIG. 3 is a graph illustrating a gamma curve.

FIG. 3 illustrates a gamma curve showing that the data voltage has different levels of gray scale according to the level thereof. The gray scale is a shade of gray including white, black and halftone, which is expressed by the level of brightness in a visual sensation. The higher the gray scale, the higher the intensity (brightness) of light emitted from the electro-luminescent element. Conversely, the lower the gray scale, the lower the intensity of light emitted from the electro-luminescent element. In other words, the intensity of light emitted from the electro-luminescent element increases when the data voltage has a higher gray scale, and decreases when the data voltage has a lower gray scale. In particular, the minimum data voltage has a lowest gray scale (black) and the maximum data voltage has a highest gray scale (white). As stated above, the level of the critical voltage DC is set between the minimum value and maximum value of the data voltage. As a result, the data voltage turns the second transistor NT2 on when being higher than the critical voltage DC, and the second transistor NT2 off when being lower than the critical voltage DC. The reason is that the gate-source voltage Vgs of the second NMOS transistor NT2 becomes positive in polarity when the data voltage is higher than the critical voltage DC, and negative in polarity when the data voltage is lower than the critical voltage DC. Here, the turning-on of the second NMOS transistor NT2 means that the second NMOS transistor NT2 adjusts the amount of current between the source terminal and drain terminal thereof according to the level of the data voltage and supplies the resulting current to the electro-luminescent element D. In contrast, the turning-off of the second NMOS transistor NT2 means that no current is supplied to the electro-luminescent element D. Namely, this means that the electro-luminescent element D emits no light (this also means the lowest gray scale (black)). In this case, the second NMOS transistor NT2 remains off irrespective of the respective levels of data voltages (data voltages lower than the critical voltage DC), so that the electro-luminescent element D always displays the brightness of the same gray scale (black) in spite of the different levels of the data voltages, which will hereinafter be again described in connection with a critical gray scale corresponding to the critical voltage DC.

Figure 4:
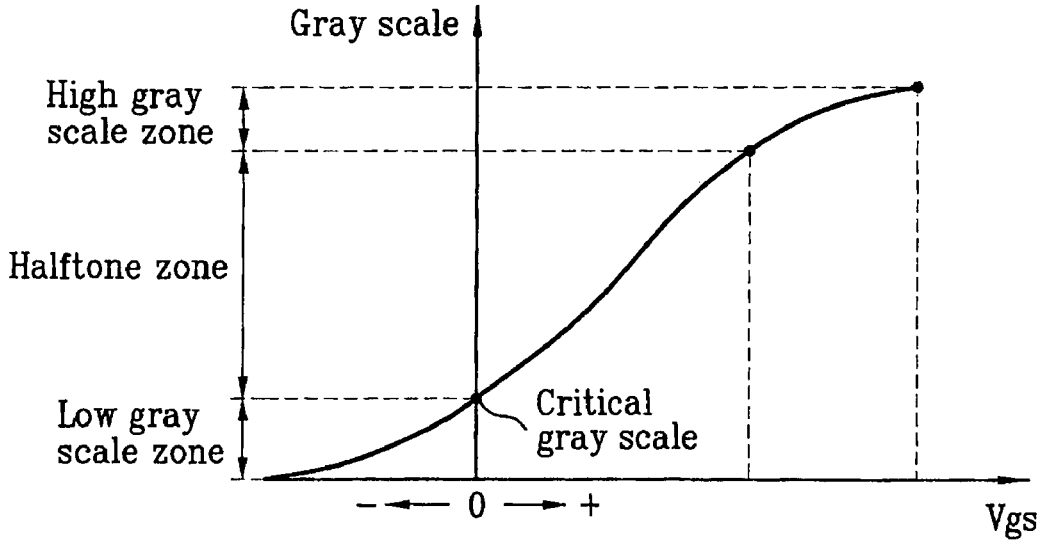
FIG. 4 is a graph illustrating a critical gray scale corresponding to a critical voltage in FIG. 3 and a variation in polarity of a gate-source voltage of a second NMOS transistor in FIG. 2.

FIG. 4 is a graph illustrating a gray scale (referred to hereinafter as a 'critical gray scale') corresponding to the critical voltage DC in FIG. 3 and a variation in polarity of the gate-source voltage Vgs of the second NMOS transistor.

As shown in FIG. 4, because gray scales lower than the critical gray scale corresponding to the critical voltage DC change the polarity of the gate-source voltage Vgs to negative, they all are displayed as the same gray scale (black). In contrast, because gray scales higher than the critical gray scale change the polarity of the gate-source voltage Vgs to positive, they each exhibit their own brightness.

To summarize, data voltages higher than the critical voltage DC are properly displayed as gray scales corresponding to the levels thereof, but data voltages lower than the critical voltage DC are displayed as the same gray scale (black). Thus, as the critical voltage DC is shifted toward the minimum value of the data voltage, the number of gray scales to be expressed is increased, but the frequency of the negative polarity of the gate-source voltage Vgs is relatively reduced. In contrast, as the critical voltage DC is shifted toward the maximum value of the data voltage, the frequency of the negative polarity of the gate-source voltage Vgs is increased, but the number of gray scales to be expressed is relatively reduced.

In an embodiment, the low gray scale zone of the gamma curve is utilized in order to optimize the critical voltage DC with the aforementioned characteristics. That is, the gamma curve shown in FIG. 3 is partitioned into a low gray scale zone where gray scales of dark shades including a black gray scale are distributed, a high gray scale zone where gray scales of bright shades including a white gray scale are distributed, and a halftone zone where gray scales of shades between the gray scales of the low gray scale zone and the gray scales of the high gray scale zone are distributed. A difference in brightness among the gray scales distributed in the low gray scale zone is invisible to the human eye. In other words, all the gray scales distributed in the low gray scale zone are seen as the same brightness (black gray scale) with the naked eye. The low gray scale zone with these characteristics forms about 30% of the entire gray scale zone. Therefore, the polarity of the gate-source voltage Vgs of the second NMOS transistor NT2 is driven to negative with respect to data voltages corresponding to the low gray scale zone, and to positive with respect to data voltages corresponding to the other zones. It may be preferable that the critical gray scale is set to a gray scale having a highest level in the low gray scale zone to maximize the frequency of the negative polarity of the gate-source voltage Vgs of the second NMOS transistor NT2. Here, the level of the critical voltage DC which is outputted from the polarity controller 200 is set according to the critical gray scale with the level as described above. Provided that the critical voltage DC is set based on the critical gray scale in this manner, the number of gray scales will be advantageously maintained as it is although all data voltages lower than the critical voltage DC are displayed as the same black gray scale.

In order to obtain the above-stated effect, a polarity controller 200 may output a pulse voltage periodically having the critical voltage DC and a voltage higher than the maximum value of the data voltage, as will hereinafter be described in more detail.

Figure 5:
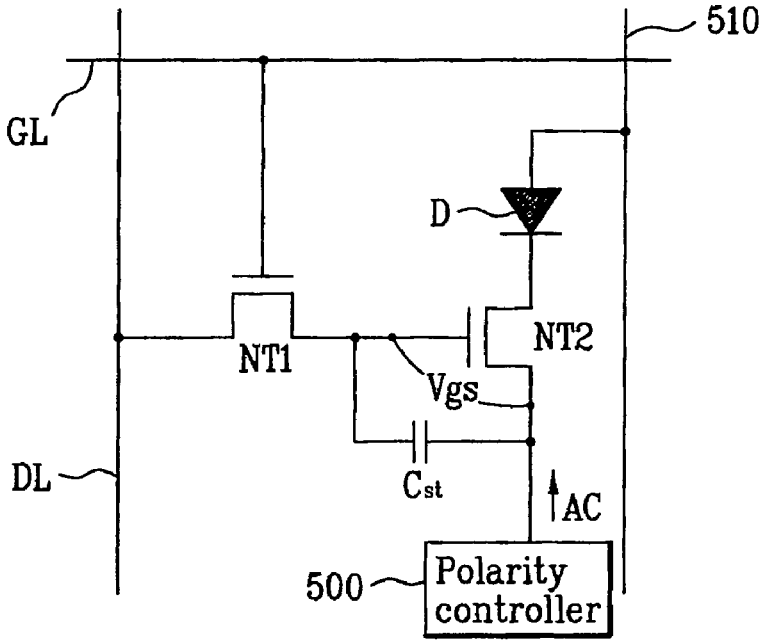
FIG. 5 is a circuit diagram showing a basic pixel structure of an organic electro-luminescent display device with a polarity controller that applies pulse voltages.
Figure 6:
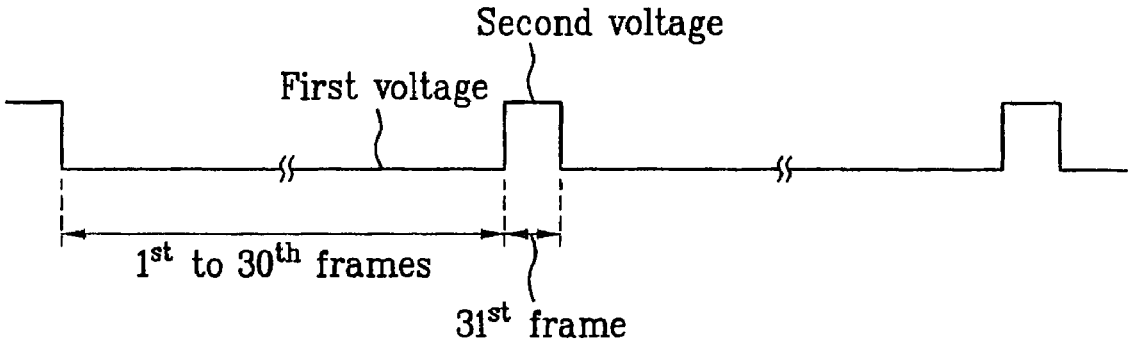
FIG. 6 is a timing diagram of a pulse voltage applied to a source terminal of a second NMOS transistor in FIG. 5.

FIG. 5 is a circuit diagram showing a basic pixel structure of an organic electro-luminescent display device with a pulse generator that outputs a second voltage periodically. FIG. 6 is a timing diagram of the pulse voltage applied to a source terminal of a second NMOS transistor in FIG. 5.

The basic pixel structure of the organic electro-luminescent display device may include, as shown in FIG. 5, a gate line GL arranged in one direction and serving to transfer a scan signal, a data line DL arranged perpendicularly to the gate line GL and serving to transfer a data voltage, an electro-luminescent element D formed in a pixel defined by the gate line GL and the data line DL, a voltage supply line 510 for supplying a DC voltage to the anode of the electro-luminescent element D, a first NMOS transistor NT1 turned on in response to the scan signal from the gate line GL for switching and outputting the data voltage from the data line DL, and a second NMOS transistor NT2 turned on in response to the data voltage outputted from the first NMOS transistor NT1 for adjusting the amount of current flowing between the source terminal and drain terminal thereof according to the level of the data voltage and supplying the resulting current to the cathode of the electro-luminescent element D. The basic pixel structure of the organic electro-luminescent display device also may include a capacitor Cst having one end connected to the gate terminal of the second NMOS transistor NT2 and the other end connected to the source terminal of the second NMOS transistor NT2 and serving to maintain the data voltage applied to the gate terminal of the second NMOS transistor NT2 for a period of one frame, and a polarity controller 500 for applying a pulse voltage AC periodically having a first voltage with a value between the minimum value and maximum value of the data voltage and a second voltage higher than the maximum value of the data voltage to the source terminal of the second NMOS transistor NT2 to vary the polarity of a gate-source voltage Vgs of the second NMOS transistor NT2.

The first voltage is a voltage having the same condition as that of the critical voltage DC as previously described in the earlier example. That is, the first voltage is a voltage corresponding to the critical gray scale having the highest level in the low gray scale zone. The pulse voltage AC has a period set on the basis of a frame. Here, the frame is a period in which one image is displayed on the screen of the organic electro-luminescent display device. The first voltage is applied to the source terminal of the second NMOS transistor NT2 for a period of several ones of a plurality of frames, and the second voltage is applied to the source terminal of the second NMOS transistor NT2 for a period of the remaining frames.

Because the second voltage is higher than the data voltage, black is displayed on the entire screen of the organic electro-luminescent display device for the frame period in which the second voltage is applied to the source terminal of the second NMOS transistor NT2. For this reason, when a larger number of frames among the total frames correspond to the frame period in which the second voltage is applied, screen flickering is liable to occur. Therefore, as shown in FIG. 6, the first voltage is applied to the source terminal of the second NMOS transistor NT2 for a period of at least thirty frames, and the second voltage is applied to the source terminal of the second NMOS transistor NT2 for a period of one frame.

The operation of the organic electro-luminescent display device with the above-stated configuration for this example will hereinafter be described in conjunction with the above-stated respective frame periods.

The first voltage is applied to the source terminal of the second NMOS transistor NT2 for the period of the first to thirtieth frames, so that the second NMOS transistor NT2 is operated in the same manner as in the above-stated first embodiment. The characteristics of images are reflected on the screen of the organic electro-luminescent display device as they are.

Thereafter, the second voltage which is higher than the maximum value of the data voltage is applied to the source terminal of the second NMOS transistor NT2 for the period of the thirty-first frame. As a result, because the data voltage which is applied to the gate terminal of the second NMOS transistor NT2 is always lower than the second voltage, the gate-source voltage Vgs of the second NMOS transistor NT2 always remains negative in polarity for the period of the thirty-first frame. Consequently, black is displayed on the entire screen of the organic electro-luminescent display device for the frame period of the thirty-first frame.

Accordingly, for the period of the first to thirtieth frames, the gate-source voltage Vgs of the second NMOS transistor NT2 selectively has the positive polarity and the negative polarity (in the same manner as in the previous embodiment). For the period of the thirty-first frame, the gate-source voltage Vgs of the second NMOS transistor NT2 has the negative polarity.

In another embodiment, periodic screen flickering may occur due to the periodic display of a frame with brightness corresponding to the black gray scale, but the frequency of the negative polarity of the gate-source voltage Vgs may be advantageously increased as compared with that in the previous embodiment.

Figure 7:
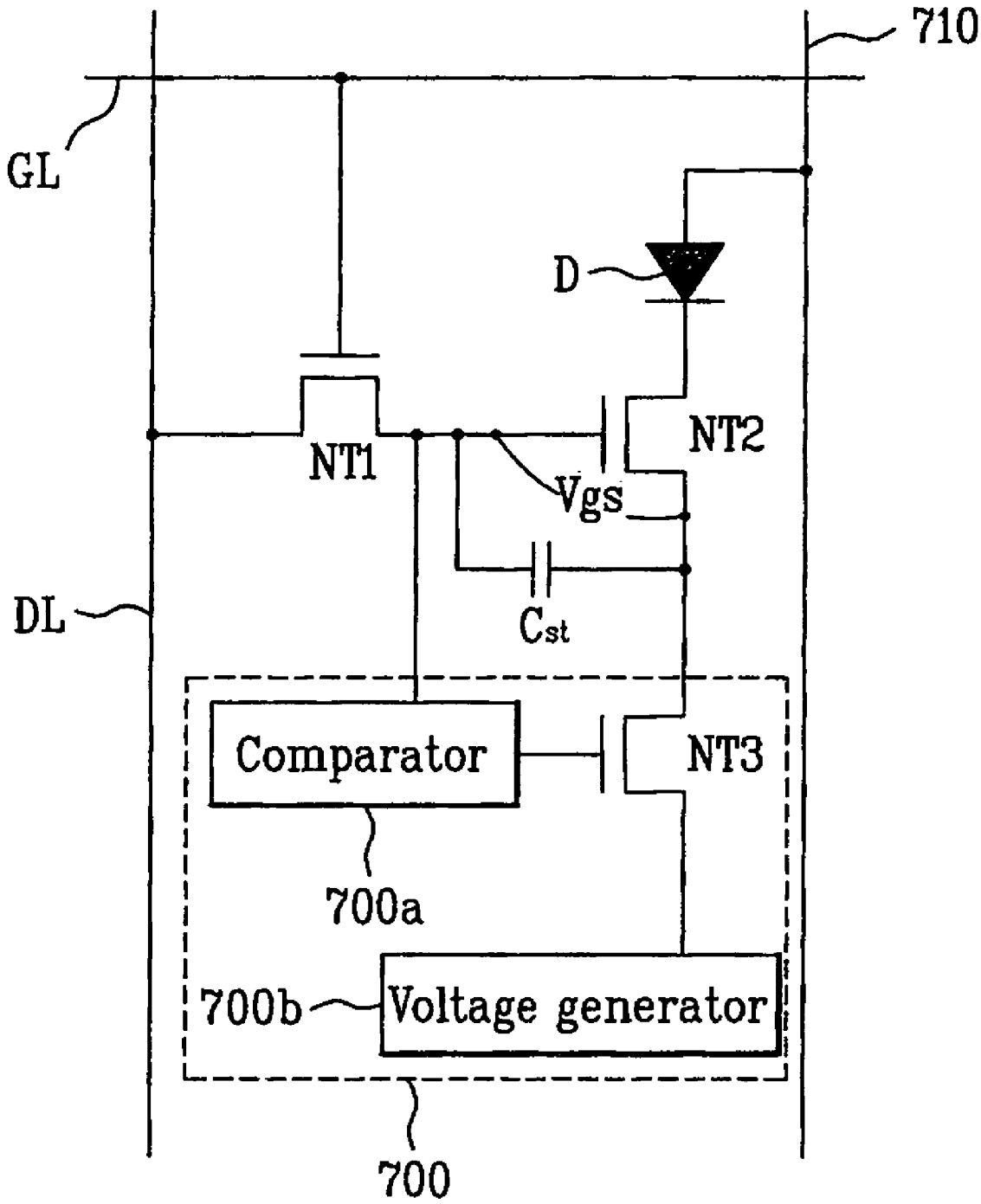
FIG. 7 is a circuit diagram showing a basic pixel structure of an organic electro-luminescent display device polarity controller that selectively applies a voltage.

An organic electro-luminescent display device according to another embodiment will hereinafter be described in detail. FIG. 7 is a circuit diagram showing a basic pixel structure of the organic electro-luminescent display device having a comparator and a voltage generator.

The basic pixel structure of the organic electro-luminescent display device may include a gate line GL arranged in one direction and serving to transfer a scan signal, a data line DL arranged perpendicularly to the gate line GL and serving to transfer a data voltage, an electro-luminescent element D formed in a pixel defined by the gate line GL and the data line DL, a voltage supply line 710 for supplying a DC voltage to the anode of the electro-luminescent element D, a first NMOS transistor NT1 turned on in response to the scan signal from the gate line GL for switching and outputting the data voltage from the data line DL, and a second NMOS transistor NT2 turned on in response to the data voltage outputted from the first NMOS transistor NT1 for adjusting the amount of current flowing between the source terminal and drain terminal thereof according to the level of the data voltage and supplying the resulting current to the cathode of the electro-luminescent element D. The basic pixel structure of the organic electro-luminescent display device also may include a capacitor Cst having one end connected to the gate terminal of the second NMOS transistor NT2 and the other end connected to the source terminal of the second NMOS transistor NT2 and serving to maintain the data voltage applied to the gate terminal of the second NMOS transistor NT2 for a period of one frame, and a polarity controller 700 for selectively applying a voltage to the source terminal of the second NMOS transistor NT2 according to the level of the data voltage applied to the gate terminal of the second NMOS transistor NT2 to vary the polarity of a gate-source voltage Vgs of the second NMOS transistor NT2.

The polarity controller 700 includes a comparator 700*a* for comparing a gray scale corresponding to the level of the data voltage with a predetermined critical gray scale and outputting a control signal when the gray scale corresponding to the level of the data voltage is lower than the critical gray scale, a voltage generator 700*b* for generating a voltage higher than the maximum value of the data voltage, and a third NMOS transistor NT3 turned on in response to the control signal from the comparator 700*a* for applying the voltage from the voltage generator 700*b* to the source terminal of the second NMOS transitor NT2. Here, the critical gray scale is a gray scale having the same condition as that of the critical gray scale described earlier. That is, the critical gray scale is a gray scale having the highest level in the low gray scale zone.

A detailed description will hereinafter be given of the operation of the organic electro-luminescent display device with the above-stated configuration The first NMOS transistor NT1 is turned on in response to the scan signal from the gate line GL to switch and output the data voltage from the data line DL. The switched data voltage is applied simultaneously to the gate terminal of the second NMOS transistor NT2 and the comparator 700*a*. At this time, the comparator 700*a* compares the gray scale corresponding to the level of the data voltage with the predetermined critical gray scale and outputs no control signal when the gray scale corresponding to the level of the data voltage is higher than the critical gray scale. As a result, no voltage is applied to the source terminal of the second NMOS transistor NT2, thereby causing the gate-source voltage Vgs of the second NMOS transistor NT2 to be maintained at the positive polarity. Accordingly, the second NMOS transistor NT2 is turned on to adjust the amount of current flowing between the source terminal and drain terminal thereof according to the level of the data voltage and supply the resulting current to the cathode of the electro-luminescent element D. Thus, the electro-luminescent element D emits light of an intensity corresponding to the amount of the current supplied thereto.

On the other hand, when the gray scale corresponding to the level of the data voltage is lower than the critical gray scale, the comparator 700*a* outputs the control signal to the gate terminal of the third NMOS transistor NT3. Then, the third NMOS transistor NT3 is turned on in response to the control signal from the comparator 700*a* to apply the voltage from the voltage generator 700*b* to the source terminal of the second NMOS transitor NT2. At this time, because the voltage from the voltage generator 700*b* is higher than the maximum value of the data voltage, the gate-source voltage Vgs of the second NMOS transistor NT2 is maintained at the negative polarity. As a result, the second NMOS transistor NT2 remains off and thus no current flows between the source terminal and drain terminal of the second NMOS transistor NT2. Consequently, the electro-luminescent element D emits no light.

Figure 8:
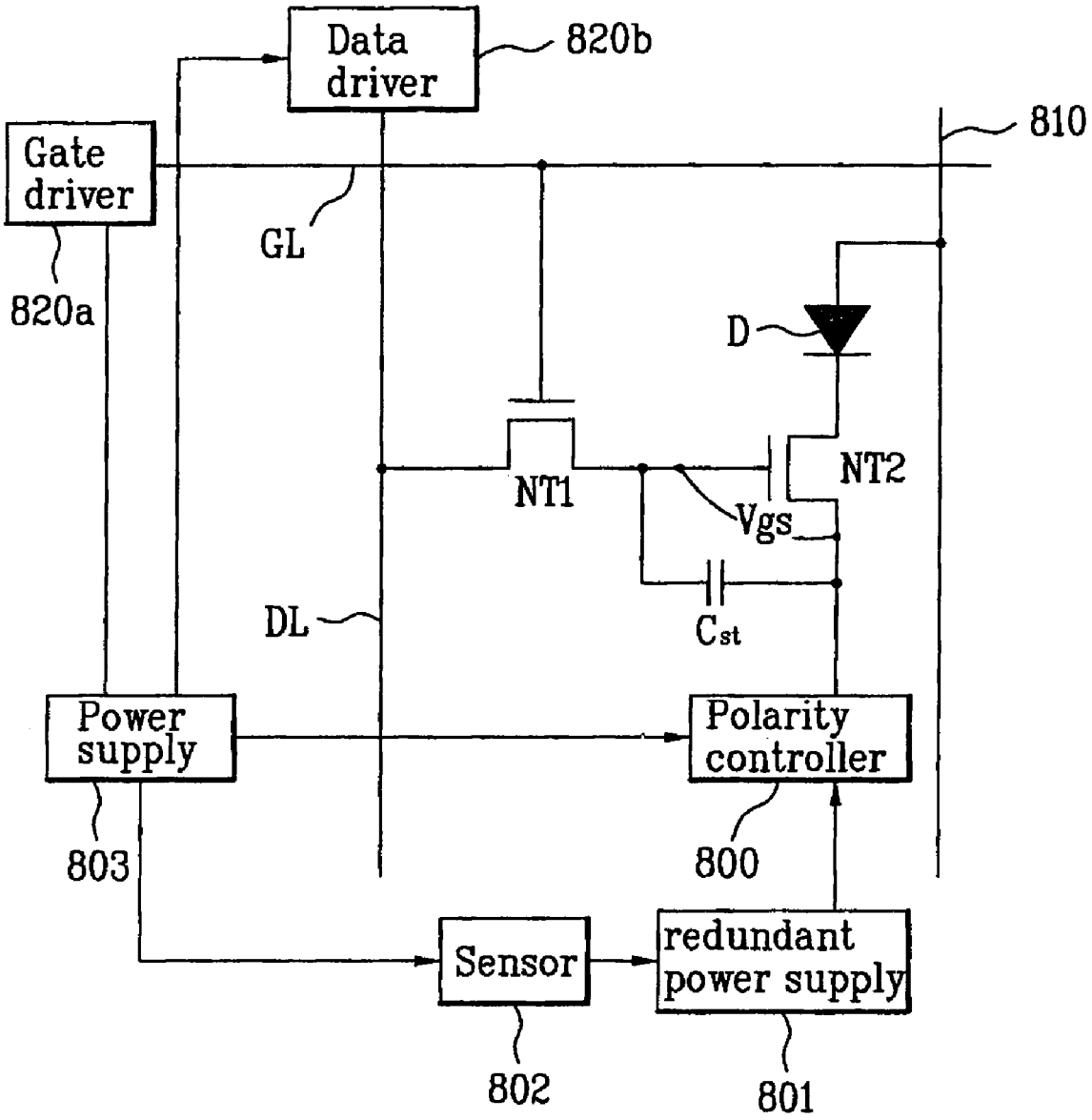
FIG. 8 is a view showing the configuration of an organic electro-luminescent display device with a data modulator.

A further example of an organic electro-luminescent display device will hereinafter be described in detail with reference to FIG. 8. The organic electro-luminescent display device may include a gate line GL and a data line DL arranged to cross each other, a gate driver 820*a* for supplying a scan signal to the gate line GL, a data driver 820*b* for supplying a data voltage to the data line DL, an electro-luminescent element D formed in a pixel defined by the gate line GL and the data line DL, a voltage supply line 810 for supplying a DC voltage to the anode of the electro-luminescent element D, a first NMOS transistor NT1 turned on in response to the scan signal from the gate line GL for switching and outputting the data voltage from the data line DL, and a second NMOS transistor NT2 turned on in response to the data voltage outputted from the first NMOS transistor NT1 for adjusting the amount of current flowing between the source terminal and drain terminal thereof according to the level of the data voltage and supplying the resulting current to the cathode of the electro-luminescent element D. The organic electro-luminescent display device also may include a capacitor Cst having one end connected to the gate terminal of the second NMOS transistor NT2 and the other end connected to the source terminal of the second NMOS transistor NT2 and serving to maintain the data voltage applied to the gate terminal of the second NMOS transistor NT2 for a period of one frame, and a polarity controller 800 for applying a critical voltage having a value between the minimum value and maximum value of the data voltage to the source terminal of the second NMOS transistor NT2 to vary the polarity of a gate-source voltage Vgs of the second NMOS transistor NT2 according to the level of the data voltage applied to the gate terminal of the second NMOS transistor NT2. The organic electro-luminescent display device also may include a power supply 803 for supplying the DC voltage to the voltage supply line 810 and supplying a drive voltage to each of the gate driver 820*a*, data driver 820*b* and polarity controller 800, a sensor 802 for receiving the drive voltage supplied from the power supply 803, sensing the supply of no power to the power supply 803 when a power switch is turned off (when the organic electro-luminescent display device is powered off) and outputting a sensing signal as a result of the sensing, and a redundant power supply 801 for supplying the drive voltage to the polarity controller 800 in response to the sensing signal from the sensor 802. The redundant power supply 801 includes a charger (not shown) for charging itself with the drive voltage from the power supply 803.

A detailed description will hereinafter be given of the operation of the organic electro-luminescent display device with the above-stated configuration. First, if the user powers on the organic electro-luminescent display device, the power supply 803 is enabled to supply a desired drive voltage to each of the gate driver 820*a*, data driver 820*b*, polarity controller 800, redundant power supply 801 and sensor 802. At this time, because the power supply 803 is enabled (because the organic electro-luminescent display device is powered on), the sensor 802 outputs no sensing signal. As a result, the redundant power supply 801 supplies no drive voltage to the polarity controller 800 and the charger thereof simply functions to charge itself with the drive voltage from the power supply 803. Meanwhile, in response to the drive voltage from the power supply 803, the gate driver 820*a* outputs the scan signal to the gate line GL, the data driver 820*b* outputs the data voltage to the data line DL, and the polarity controller 800 outputs the critical voltage to the source terminal of the second NMOS transistor NT2. The critical voltage is a voltage having the same condition as that of the critical voltage described previously. That is, the critical voltage is a voltage corresponding to the critical gray scale having the highest level in the low gray scale zone. If the power supply 803 is enabled as power is applied to the organic electro-luminescent display device, as stated above, this structure is operated in the same manner as the previous structure. Namely, the gate-source voltage Vgs of the second NMOS transistor NT2 selectively has the positive polarity and the negative polarity according to the level of the data voltage which is applied to the gate terminal of the second NMOS transistor NT2.

On the other hand, if the user powers off the organic electro-luminescent display device (i.e., if the user powers off an associated monitor or TV), the power supply 803 is disabled, so that the gate driver 820*a*, data driver 820*b* and polarity controller 800 are not operated. Of course, no DC voltage is supplied to the voltage supply line 810. As a result, the first NMOS transistor NT1 and the second NMOS transistor NT2 are not operated. At this time, the sensor 802 senses the supply of no drive voltage from the power supply 803 and outputs the resulting sensing signal to the redundant power supply 801. Then, the redundant power supply 801 applies the drive voltage stored in the charger thereof to the polarity controller 800 in response to the sensing signal from the sensor 802. Then, the polarity controller 800 generates the critical voltage using the drive voltage from the redundant power supply 801 and supplies it to the source terminal of the second NMOS transistor NT2. At this time, because no data voltage is applied to the gate terminal of the second NMOS transistor NT2 (i.e., 0V is applied to the gate terminal of the second NMOS transistor NT2), the gate-source voltage Vgs of the second NMOS transistor NT2 is maintained at the negative polarity. Notably, the redundant power supply 801 maintains the drive voltage as much as the capacity of the charger, so that it transfers the drive voltage to the polarity controller 800 only for a predetermined period of time. In brief, the gate-source voltage Vgs of the second NMOS transistor NT2 selectively has the positive polarity and the negative polarity according to the level of the data voltage while the organic electro-luminescent display device is powered on, and is maintained at the negative polarity for the predetermined time period under the condition that the organic electro-luminescent display device is powered off.

Figure 9:
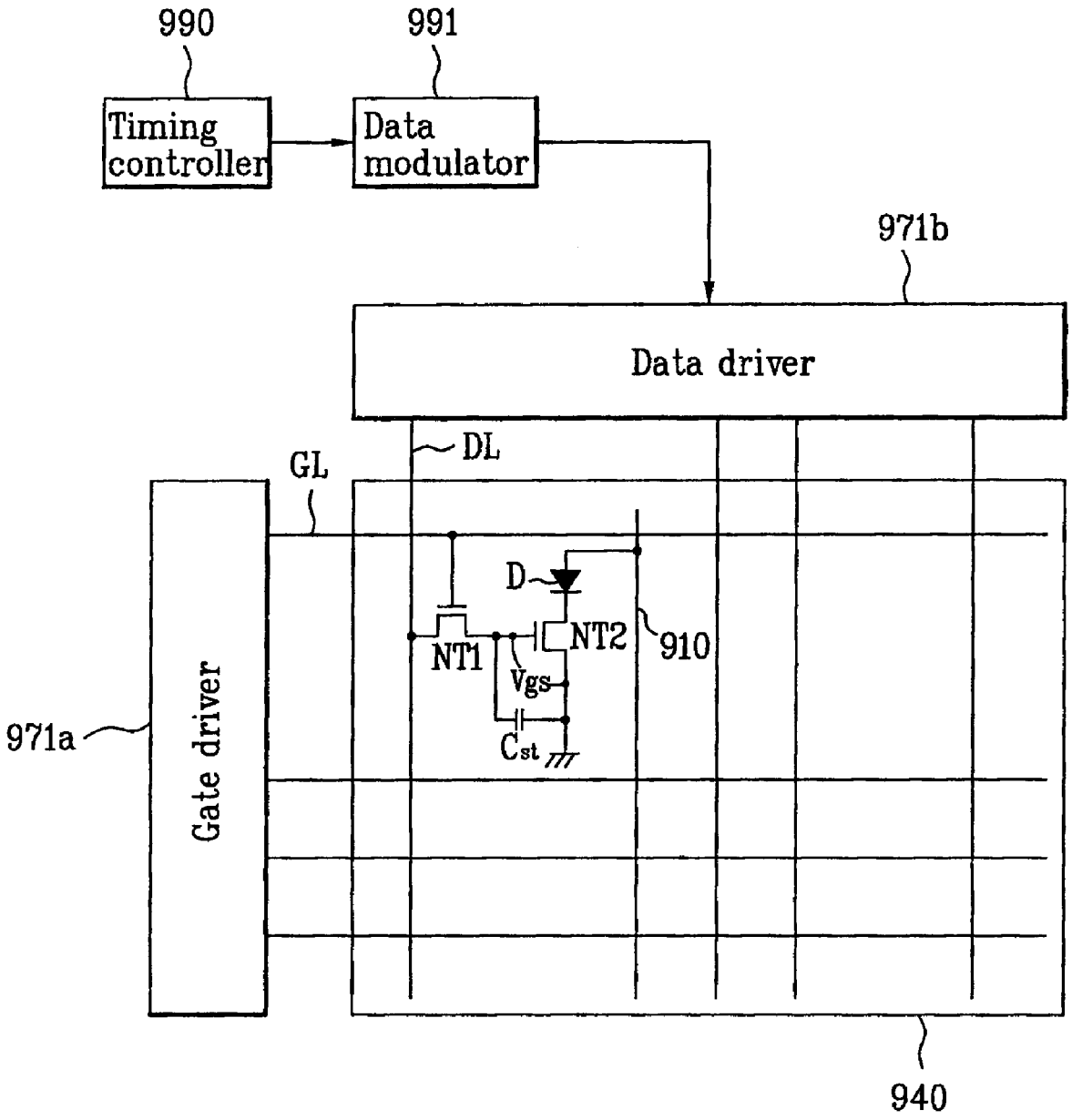
FIG. 9 is a view showing the configuration of an organic electro-luminescent display device with a data modulator.

FIG. 9 shows a configuration of the organic electro-luminescent display device with a data modulator.

The organic electro-luminescent display device has an organic panel 940 including a plurality of gate lines GL and a plurality of data lines DL arranged to cross each other, a data modulator 991 for receiving image data from a timing controller 990, inserting dummy data between the received image data and outputting the resulting image data, a data driver 971*b* for receiving the dummy data-inserted image data from the data modulator 991, generating a positive data voltage based on the received image data and a negative dummy data voltage based on the dummy data and supplying the generated positive data voltage and negative dummy data voltage to the data lines DL of the organic panel 940, and a gate driver 971*a* for sequentially outputting a first scan pulse synchronized with the positive data voltage and a second scan pulse synchronized with the negative dummy data voltage to the gate lines GL of the organic panel 940 on a frame-by-frame basis. The organic electro-luminescent display device includes further, an electro-luminescent element D formed in each pixel of the organic panel 940, a voltage supply line 910 for supplying a DC voltage to the anode of the electro-luminescent element D, a first NMOS transistor NT1 having a source terminal connected to a ground terminal and serving to switch and output the positive data voltage from a corresponding one of the data lines DL in response to the first scan pulse from a corresponding one of the gate lines GL and switch and output the negative dummy data voltage from the corresponding data line DL in response to the second scan pulse from the corresponding gate line GL, a second NMOS transistor NT2 for adjusting the amount of current flowing between the source terminal and drain terminal thereof according to the positive data voltage and negative dummy data voltage from the first NMOS transistor NT1 and supplying the resulting current to the cathode of the electro-luminescent element D, and a capacitor Cst having one end connected to the gate terminal of the second NMOS transistor NT2 and the other end connected to the source terminal of the second NMOS transistor NT2 and serving to alternately maintain the positive data voltage and negative dummy data voltage applied to the gate terminal of the second NMOS transistor NT2 for a period of one frame.

By virtue of this configuration, the polarity of the gate-source voltage Vgs of the second NMOS transistor NT2 can be periodically changed by periodically applying the positive data voltage and the negative dummy data voltage to the gate terminal of the second NMOS transistor NT2.

A detailed description will hereinafter be given of the operation of the organic electro-luminescent display device with the above-stated configuration. First, the data modulator 991 receives image data from the timing controller 990, inserts dummy data between the received image data and outputs the resulting image data. The data driver 971*b* receives the dummy data-inserted image data from the data modulator 991, generates a positive data voltage based on the received image data and a negative dummy data voltage based on the dummy data and supplies the generated positive data voltage and negative dummy data voltage to the data lines DL of the organic panel 940. The gate driver 971*a* generates a first scan pulse synchronously with the positive data voltage and supplies the generated first scan pulse to the gate lines GL. The first scan pulse supplied to the corresponding gate line GL is applied to the gate terminal of the first NMOS transistor NT1. As a result, the first NMOS transistor NT1 is turned on to switch and apply the positive data voltage synchronized with the first scan pulse from the corresponding data line DL to the gate terminal of the second NMOS transistor NT2. Then, the second NMOS transistor NT2 is turned on to generate current corresponding to the positive data voltage between the source terminal and drain terminal thereof and supply the resulting current to the cathode of the electro-luminescent element D, so that the electro-luminescent element D emits light. At this time, the positive data voltage is maintained in the capacitor Cst. Thereafter, before the next frame is started (i.e., before the next first scan pulse indicative of the next frame is outputted), the gate driver 971*a* supplies a second scan pulse synchronized with the negative dummy data voltage to the gate lines GL. The second scan pulse supplied to the corresponding gate line GL is applied to the gate terminal of the first NMOS transistor NT1. As a result, the second NMOS transistor NT2 is turned off, thereby causing the electro-luminescent element D to emit no light. At this time, the negative dummy data voltage is maintained in the capacitor Cst.

The first scan pulse and the second scan pulse will hereinafter be described in more detail.

Figure 10:
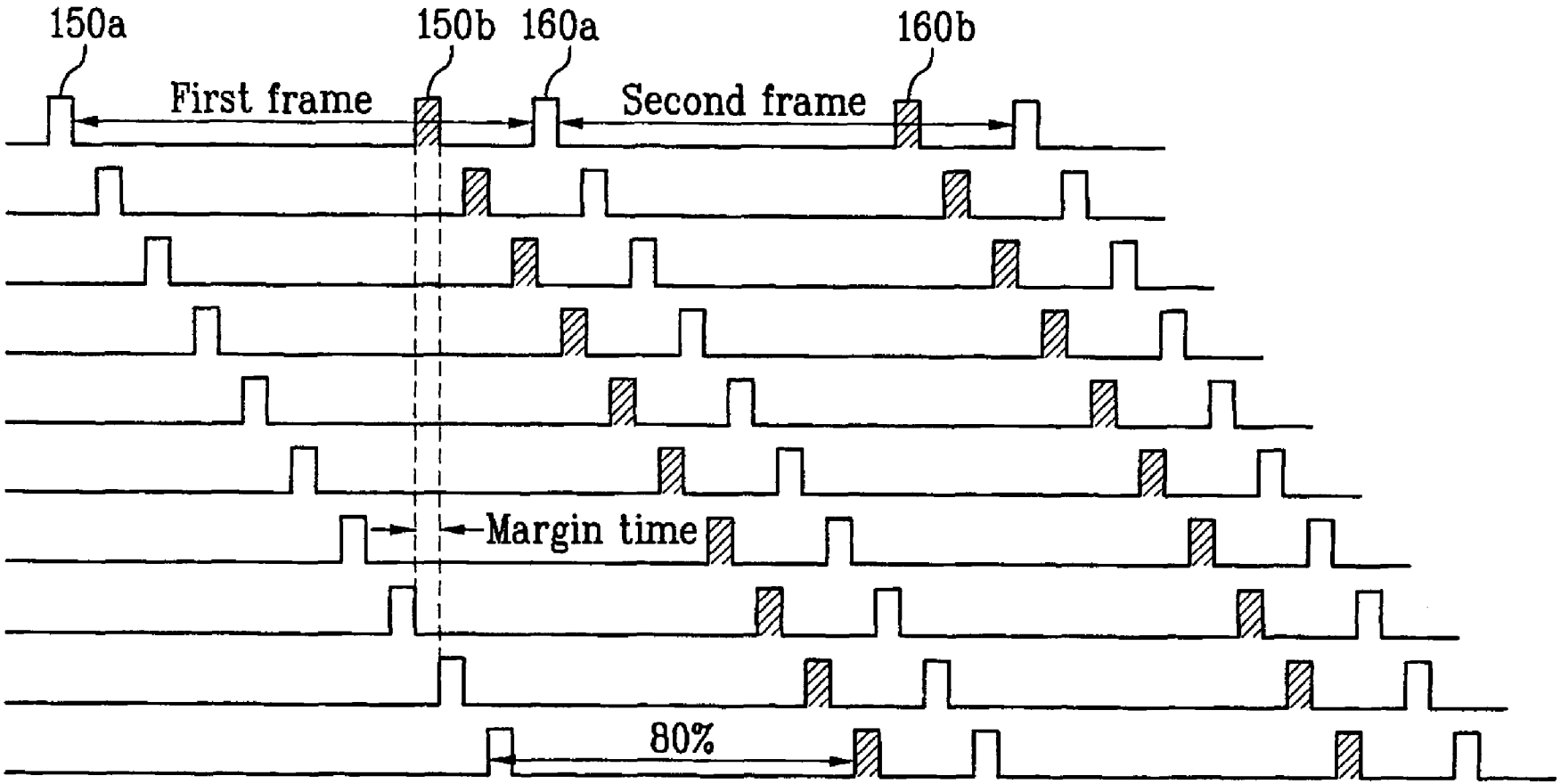
FIG. 10 is a timing diagram of a first scan pulse and second scan pulse applied to each gate line in FIG. 9.

FIG. 10 is a timing diagram of the first scan pulse and second scan pulse applied to each gate line in FIG. 9.

The first scan pulse 150*a* or 160*a* and the second scan pulse 150*b* or 160*b* are sequentially applied in pair to each gate line GL for every frame. The second scan pulse 150*b* or 160*b* is outputted so as to be placed between the first scan pulses 150*a* and 160*a* of the adjacent frames. For example, the second scan pulse 150*b* of the first frame is outputted so as to be placed between the first scan pulse 150*a* of the first frame and the first scan pulse 160*a* of the second frame. At this time, if the second scan pulse 150*b* of the first frame is placed closer to the first scan pulse 150*a* of the first frame, the time interval between the second scan pulse 150*b* of the first frame and the first scan pulse 150*a* of the first frame becomes smaller (i.e., the sustain time of the first scan pulse 150*a* of the first frame becomes shorter), resulting in a reduction in time for which the positive data voltage, applied to the second NMOS transistor NT2 synchronously with the first scan pulse 150*a* of the first frame, is maintained in the capacitor Cst. Conversely, if the second scan pulse 150*b* of the first frame is placed closer to the first scan pulse 160*a* of the second frame, the time interval between the second scan pulse 150*b* of the first frame and the first scan pulse 150*a* of the first frame becomes larger (i.e., the sustain time of the first scan pulse 150*a* of the first frame becomes longer), resulting in an increase in time for which the positive data voltage, applied to the second NMOS transistor NT2 synchronously with the first scan pulse 150*a* of the first frame, is maintained in the capacitor Cst. That is, in order to express an image corresponding to the positive data voltage for the longest time in one frame, it is advantageous to increase the time interval between the first scan pulse 150*a* or 160*a* and the second scan pulse 150*b* or 160*b* in one frame. However, the larger the time interval between the first scan pulse 150*a* or 160*a* and the second scan pulse 150*b* or 160*b* in one frame, the shorter the distance between the second scan pulse 150*b* of the first frame and the first scan pulse 160*a* of the second frame, resulting in a reduction in time for which the negative dummy data voltage, applied to the second NMOS transistor NT2 synchronously with the second scan pulse 150*b*, is maintained in the capacitor Cst. This means a reduction in time for which the gate-source voltage Vgs of the second NMOS transistor NT2 can be maintained at the negative polarity. The optimized time interval between the first scan pulse 150*a* or 160*a* and the second scan pulse 150*b* or 160*b* in one frame is defined as follows.

Assuming that the time from a falling edge of the first scan pulse 150*a* of the first frame to a rising edge of the first scan pulse 160*a* of the second frame is 100, the second scan pulse 150*b* of the first frame is outputted at a time of about 80. Thus, the positive data voltage is applied to the gate terminal of the second NMOS transistor NT2 in 80% of the period of one frame and the negative dummy data voltage is applied to the gate terminal of the second NMOS transistor NT2 in the remaining 20%.

At this time, the first scan pulse 150*a* or 160*a* and second scan pulse 150*b* or 160*b* applied to the corresponding gate line GL may not temporally overlap with the first scan pulses 150*a* or 160*a* and second scan pulses 150*b* or 160*b* applied to the remaining gate lines GL. To avoid an overlap, the first scan pulses 150*a* or 160*a* are sequentially applied to the gate lines GL with a temporal margin being present therebetween, and the second scan pulses 150*b* or 160*b* are sequentially applied to the gate lines GL at the margin time (blank time) present between the first scan pulses 150*a* or 160*a*.

In this manner, the polarity of the gate-source voltage Vgs of the second NMOS transistor NT2 can be periodically changed by applying the positive data voltage to the gate terminal of the second NMOS transistor NT2 at the application time of the first scan pulse 150*a* or 160*a* and applying the negative data voltage to the gate terminal of the second NMOS transistor NT2 at the application time of the second scan pulse 150*b* or 160*b*.

Figure 11:
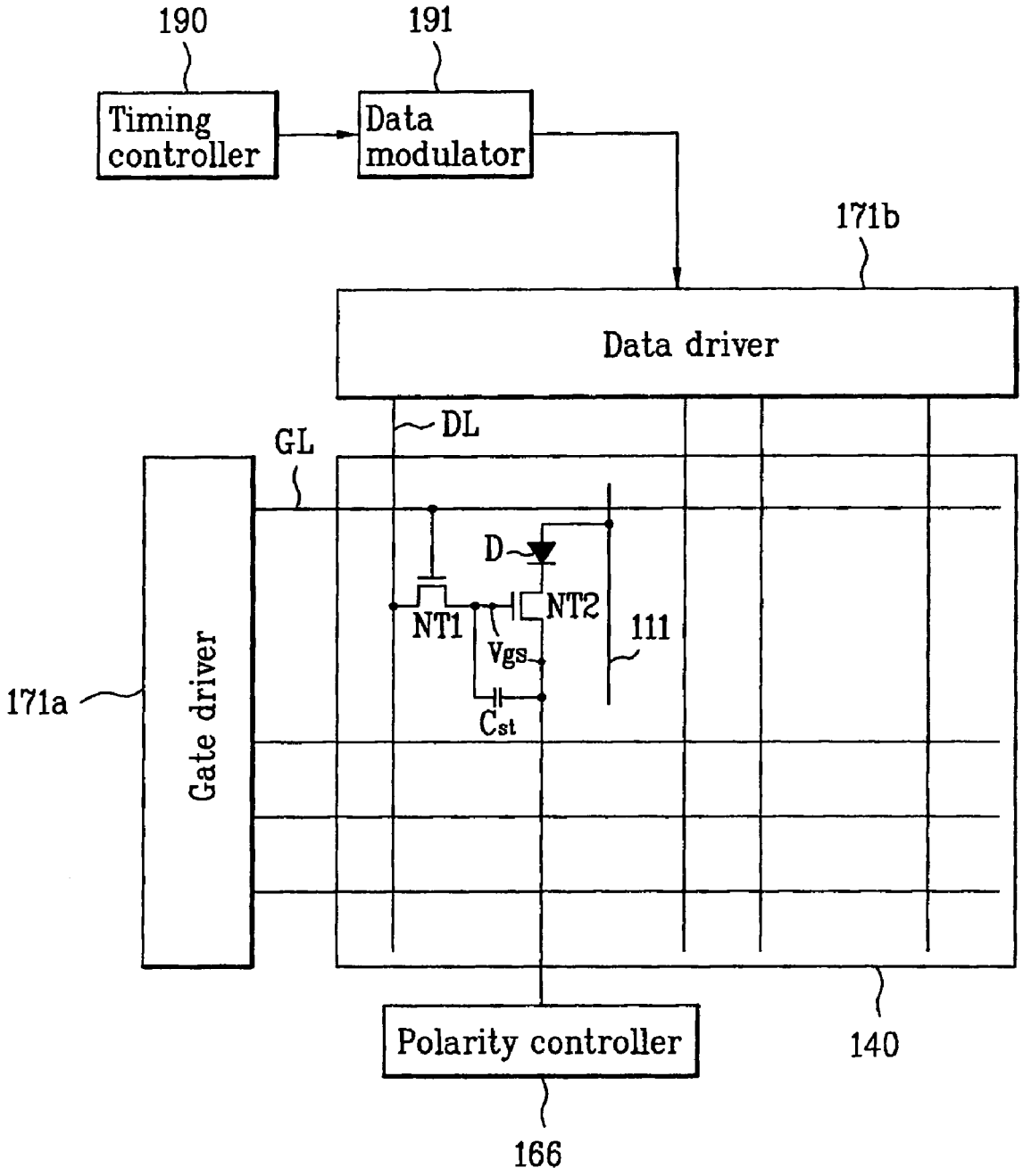
FIG. 11 is a view showing the configuration of an organic electro-luminescent display device with a polarity modulator.

FIG. 11 shows another possible configuration of the organic electro-luminescent display device. The organic electro-luminescent display device may have an organic panel 140 including a plurality of gate lines GL and a plurality of data lines DL arranged to cross each other, a data modulator 191 for receiving image data from a timing controller 190, inserting dummy data between the received image data and outputting the resulting image data, a data driver 171*b* for receiving the dummy data-inserted image data from the data modulator 191, generating a data voltage based on the received image data and a dummy data voltage based on the dummy data, which is lower than the minimum value of the data voltage, and supplying the generated data voltage and dummy data voltage to the data lines DL of the organic panel 140, a gate driver 171*a* for sequentially outputting a first scan pulse synchronized with the data voltage and a second scan pulse synchronized with the dummy data voltage to the gate lines GL of the organic panel 140, an electro-luminescent element D formed in a pixel defined by each of the gate lines GL and each of the data lines DL, and a voltage supply line 111 for supplying a DC voltage to the anode of the electro-luminescent element D. The organic electro-luminescent display device may also include a first NMOS transistor NT1 for switching and outputting the data voltage from a corresponding one of the data lines DL in response to the first scan pulse from a corresponding one of the gate lines GL and switching and outputting the dummy data voltage from the corresponding data line DL in response to the second scan pulse from the corresponding gate line GL, a second NMOS transistor NT2 for adjusting the amount of current flowing between the source terminal and drain terminal thereof according to the data voltage and dummy data voltage from the first NMOS transistor NT1 and supplying the resulting current to the cathode of the electro-luminescent element D, a polarity controller 166 for applying a voltage having a value between the minimum value and maximum value of the data voltage to the source terminal of the second NMOS transistor NT2 to vary the polarity of a gate-source voltage Vgs of the second NMOS transistor NT2 according to the level of the data voltage, and a capacitor Cst having one end connected to the gate terminal of the second NMOS transistor NT2 and the other end connected to the source terminal of the second NMOS transistor NT2 and serving to maintain the data voltage applied to the gate terminal of the second NMOS transistor NT2 for a period of one frame.

The voltage from the polarity controller 166 is the same as the critical voltage DC as described earlier. The dummy data voltage is substantially 0V. Accordingly, when the second scan pulse is applied to the first NMOS transistor NT1, 0V is always applied to the gate terminal of the second NMOS transistor NT2. As a result, the voltage at the gate terminal of the second NMOS transistor NT2 is always lower than the voltage at the source terminal of the second NMOS transistor NT2 to which the voltage from the polarity controller 166 is applied. Consequently, when the second scan pulse is outputted, the gate-source voltage Vgs of the second NMOS transistor NT2 is always maintained at the negative polarity. On the other hand, when the first scan pulse is applied to the first NMOS transistor NT1, the second NMOS transistor NT2 is operated in the same manner as in the first embodiment. Also, the first scan pulse and the second scan pulse are the same as those in the fifth embodiment.

As apparent from the above description, the organic electro-luminescent display device and the method for driving the same have effects as follows.

Firstly, a critical voltage having a value between the minimum value and maximum value of a data voltage is applied to a source terminal of a switching element to vary the polarity of a gate-source voltage of the switching element according to the level of the data voltage applied to the gate terminal of the switching element, thereby preventing the switching element from being deteriorated.

Secondly, a pulse voltage periodically having the critical voltage and a voltage higher than the maximum value of the data voltage is applied to the source terminal of the switching element to vary the polarity of the gate-source voltage of the switching element on a frame-by-frame basis according to the level of the data voltage applied to the gate terminal of the switching element, thereby preventing the switching element from being deteriorated.

Thirdly, while the organic electro-luminescent display device is powered on, the critical voltage is applied to vary the polarity of the gate-source voltage of the switching element. In addition, even while the organic electro-luminescent display device is powered off, the critical voltage is applied for a predetermined period of time to maintain the gate-source voltage of the switching element at a negative polarity, thereby preventing the switching element from being deteriorated.

Fourthly, dummy data is inserted between image data, and a positive data voltage based on the image data is applied to the gate terminal of the switching element and a negative dummy data voltage based on the dummy data is periodically applied to the gate terminal of the switching element, to vary the polarity of the gate-source voltage of the switching element, thereby preventing the switching element from being deteriorated.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic electro-luminescent display device comprising:

a plurality of pixels, the pixel having an electro-luminescent element that emits light according to an amount of current supplied thereto;

a first switching element that switches a data voltage from a data line in response to a scan signal from a gate line;

a second switching element that adjusts the amount of current supplied to the electro-luminescent element according to the data voltage switched by the first switching element; and a polarity controller that applies a voltage having a value between a minimum value and a maximum value of the data voltage to a source terminal of the second switching element that varies a polarity of a gate-source voltage of the second switching element according to the data voltage applied to a gate terminal of the second switching element, wherein the voltage from the polarity controller is a direct current (DC) voltage which has the same level as that of a data voltage corresponding to a gray scale having a highest level in a gray scale zone that is less than 30% of an entire gray scale zone predefined according to data voltages.

2. The organic electro-luminescent display device as set forth in claim 1, further comprising:

a gate driver that provides the scan signal to the gate line;

a data driver that provides the data voltage to the data line;

a power supply that supplies a drive voltage to each of the gate driver, data driver and polarity controller;

a sensor that senses when the power supply does not output the drive voltage and outputs a resulting sensing signal; and a redundant power supply that supplies the drive voltage to the polarity controller in response to the sensing signal from the sensor.

3. The organic electro-luminescent display device as set forth in claim 2, wherein the redundant power supply includes a charger that charges the redundant power supply with the drive voltage from the power supply.

4. An organic electro-luminescent display device comprising:

a plurality of pixels, the pixels having an electro-luminescent element that emits light according to a current supplied thereto;

a first switching element that switches a data voltage from a data line in response to a scan signal from a gate line;

a second switching element that adjusts the amount of the current supplied to the electro-luminescent element according to the data voltage switched by the first switching element; and a polarity controller that applies a pulse voltage to a source terminal of the second switching element to vary a polarity of a gate-source voltage of the second switching element, the pulse voltage periodically having a first voltage with a value between a minimum value and a maximum value of the data voltage and a second voltage that is higher than the maximum value of the data voltage, wherein the first voltage has the same level as that of a data voltage corresponding to a gray scale having a highest level in a gray scale zone that is less than 30% of an entire gray scale zone predefined according to data voltages.

5. An organic electro-luminescent display device comprising:

a plurality of pixels, the pixels having an electro-luminescent element that emits light according to an amount of a current supplied thereto;

a first switching element that switches a data voltage from a data line in response to a scan signal from a gate line;

a second switching element that adjusts the amount of the current supplied to the electro-luminescent element according to the data voltage switched by the first switching element; and a polarity controller that selectively applies a voltage to a source terminal of the second switching element according to the data voltage applied to a gate terminal of the second switching element that varies a polarity of a gate-source voltage of the second switching element;

wherein the polarity controller further comprises: a comparator that compares a gray scale corresponding to a level of the data voltage with a predetermined critical gray scale and outputs a control signal only when the gray scale corresponding to the level of the data voltage is lower than the critical gray scale, a voltage generator that generates a voltage, and a third switching element turned on in response to the control signal from the comparator and applies the voltage from the voltage generator to the source terminal of the second switching element;

wherein the critical gray scale has a highest level in a gray scale zone that is less than 30% of an entire gray scale predefined according to data voltages.

6. The organic electro-luminescent display device as set forth in claim 5, wherein the voltage from the voltage generator is a DC voltage higher than a maximum value of the data voltage.

7. An organic electro-luminescent display device comprising:

a plurality of pixels, the pixels having an electro-luminescent element that emits light according to an amount of a current supplied thereto;

a data modulator that receives image data from a timing controller, inserts dummy data between the received image data and outputs the resulting image data;

a data driver that generates a data voltage based on the image data and a dummy data voltage based on the dummy data and supplies the generated data voltage and dummy data voltage to a plurality of data lines, the dummy data voltage having a value lower than a minimum value of the data voltage;

a gate driver that sequentially outputs a first scan pulse synchronized with the data voltage and a second scan pulse synchronized with the dummy data voltage to each gate line on a frame-by-frame basis;

a first switching element that switches the data voltage and the dummy data voltage in response to the first scan pulse and the second scan pulse, respectively;

a second switching element formed in each pixel that adjusts the amount of the current supplied to the electro-luminescent element according to the data voltage and dummy data voltage switched by the first switching element; and a polarity controller that applies a voltage having a value between the minimum value and a maximum value of the data voltage to a source terminal of the second switching element to vary a polarity of a gate-source voltage of the second switching element according to the data voltage, wherein the voltage from the polarity controller has the same level as that of a data voltage corresponding to a gray scale having a highest level in a gray scale zone less than 30% of a total gray scale zone predefined according to data voltages.

8. The organic electro-luminescent display device as set forth in claim 7, further comprising a capacitor connected between a gate terminal of the second switching element and a source terminal thereof, the capacitor alternately maintaining the data voltage and the dummy data voltage for a period of one frame.

9. The organic electro-luminescent display device as set forth in claim 8, wherein the second scan pulse of an nth frame applied to an arbitrary one of the gate lines is placed between the first scan pulse of the nth frame applied to the arbitrary gate line and the first scan pulse of an (n+1)th frame applied to the arbitrary gate line, the second scan pulse of the nth frame being applied to the arbitrary gate line at a time corresponding to 80% of a time from a falling edge of the first scan pulse of the nth frame to a rising edge of the first scan pulse of the (n+1)th frame.

10. The organic electro-luminescent display device as set forth in claim 9, wherein the first scan pulses corresponding respectively to the gate lines are sequentially applied to the corresponding gate lines with a temporal margin of time being present therebetween, and the second scan pulses corresponding respectively to the gate lines are sequentially applied to the corresponding gate lines at the temporal margin of time present between the first scan pulses.

11. A method for driving an organic electro-luminescent display device, the display device including an electro-luminescent element formed in each pixel for emitting light according to current supplied thereto, a first switching element for switching a data voltage from a data line in response to a scan signal from a gate line, and a second switching element for adjusting the amount of the current supplied to the electro-luminescent element according to the data voltage switched by the first switching element, the method comprising the step of:

applying a voltage having a value between a minimum value and maximum value of the data voltage to a source terminal of the second switching element to vary a polarity of a gate-source voltage of the second switching element according to the data voltage applied to a gate terminal of the second switching element, wherein the voltage applied to the source terminal of the second switching element has the same level as that of a data voltage corresponding to a gray scale having a highest level in a gray scale zone less than 30% of total gray scale zone predefined according to data voltages.

12. A method for driving an organic electro-luminescent display device, the display device including a plurality of pixels, the pixels having an electro-luminescent element formed in each pixel that emits light according to current supplied thereto, a first switching element that switches a data voltage from a data line in response to a scan signal from a gate line, and a second switching element that adjusts the amount of the current supplied to the electro-luminescent element according to the data voltage switched by the first switching element, the method comprising:

applying a pulse voltage to a source terminal of the second switching element;

varying a polarity of a gate-source voltage of the second switching element according to the data voltage applied to a gate terminal of the second switching element; and changing the pulse voltage periodically to have a first voltage with a value between a minimum value and maximum value of the data voltage and a second voltage higher than the maximum value of the data voltage, wherein the first voltage has the same level as that of a data voltage corresponding to a gray scale having a highest level in a gray scale zone less than 30% of a total gray scale zone predefined according to data voltages.

13. A method for driving an organic electro-luminescent display device, the display device including a plurality of pixels, the pixels having an electro-luminescent element that emits light according to an amount of a current supplied thereto, a first switching element that switches a data voltage from a data line in response to a scan signal from a gate line, and a second switching element that adjusts the amount of the current supplied to the electro-luminescent element according to the data voltage switched by the first switching element, the method comprising the step of:

selectively applying a voltage to a source terminal of the second switching element according to the data voltage applied to a gate terminal of the second switching element that varies a polarity of a gate-source voltage of the second switching element;

wherein the step of selectively applying a voltage to a source terminal of the second switching element includes comparing a gray scale corresponding to a level of the data voltage with a predetermined critical gray scale, outputting a control signal only when the gray scale corresponding to the level of the data voltage is lower than the critical gray scale, and applying the voltage to the source terminal of the second switching element in response to the control signal;

wherein the critical gray scale has a highest level in a gray scale zone that is less than 30% of an entire gray scale predefined according to data voltages.

14. The method as set forth in claim 13, wherein the voltage applied to the source terminal of the second switching element is higher than a maximum value of the data voltage.

15. A method for driving an organic electro-luminescent display device, the display device including a plurality of pixels, the pixels having an electro-luminescent element that emits light according to an amount of a current supplied thereto, a first switching element that switches a data voltage from a data line in response to a scan signal from a gate line, and a second switching element that adjusts the amount of the current supplied to the electro-luminescent element according to the data voltage switched by the first switching element, the method comprising:

sensing an on/off state of the organic electro-luminescent display device; and applying a voltage to a source terminal of the second switching element at the moment that both the first switching element and second switching element are turned off as the organic electro-luminescent display device is powered off, the voltage varies a polarity of a gate-source voltage of the second switching element, wherein the voltage is a direct current (DC) voltage which has the same level as that of a data voltage corresponding to a gray scale having a highest level in a gray scale zone that is less than 30% of an entire gray scale zone predefined according to data voltages.

16. A method for driving an organic electro-luminescent display device, the display device including a plurality of pixels, the pixels having an electro-luminescent element that emits light according to an amount of a current supplied thereto, a first switching element that switches a data voltage from a data line in response to a scan signal from a gate line, and a second switching element that adjusts the amount of the current supplied to the electro-luminescent element according to the data voltage switched by the first switching element, the method comprising:

receiving image data from a timing controller;

inserting dummy data between the received image data, the dummy data having a value lower than a minimum value of the data voltage;

outputting a data voltage based on the image data and the dummy data voltage;

applying a first scan pulse synchronized with the data voltage to a gate terminal of the first switching element to turn on the first switching element so as to apply the data voltage to a gate terminal of the second switching element;

applying a second scan pulse synchronized with the dummy data voltage to the gate terminal of the first switching element to turn on the first switching element so as to apply the dummy data voltage to the gate terminal of the second switching element; and applying a voltage having a value between the minimum value and a maximum value of the data voltage to a source terminal of the second switching element to vary a polarity of a gate-source voltage of the second switching element, wherein the voltage is a direct current (DC) voltage which has the same level as that of a data voltage corresponding to a gray scale having a highest level in a gray scale zone that is less than 30% of an entire gray scale zone predefined according to data voltages.

* * * * *